US005224237A

United States Patent [19]

Ambrosiano

[11] Patent Number: 5,224,237

[45] Date of Patent: Jul. 6, 1993

[54] CONTROLLER FOR STEAM GENERATOR FOR HOUSEHOLD USE

[75] Inventor: Joseph Ambrosiano, Serignan, France

[73] Assignee: Radwulf S.A., Switzerland

[21] Appl. No.: 790,192

[22] Filed: Nov. 7, 1991

[30] Foreign Application Priority Data

Nov. 16, 1990 [CH] Switzerland ..... 3648/90

[51] Int. Cl.[5] ..... A47L 7/00

[52] U.S. Cl. ..... 15/322; 15/339; 68/222

[58] Field of Search ..... 15/320, 322, 339, 319; 68/222, 240

[56] References Cited

U.S. PATENT DOCUMENTS

| | | | |
|---|---|---|---|
| 2,787,900 | 4/1957 | Chrisman | 68/222 X |
| 3,030,792 | 4/1962 | Bader | 68/222 X |
| 3,636,285 | 1/1972 | Wickham et al. | 15/339 X |
| 3,940,826 | 3/1976 | Phillips et al. | 15/320 |
| 4,458,377 | 7/1984 | Frohbieter | 15/320 |
| 4,485,518 | 12/1984 | Kasper | 15/322 |
| 4,559,667 | 12/1985 | Fitzwater | 15/322 X |
| 4,821,364 | 4/1989 | McAllister et al. | 15/322 |

FOREIGN PATENT DOCUMENTS

| | | | |
|---|---|---|---|
| 3511666 | 10/1986 | Fed. Rep. of Germany | 15/339 |

*Primary Examiner*—Stephen F. Gerrity
*Attorney, Agent, or Firm*—Silverman, Cass & Singer, Ltd.

[57] ABSTRACT

A steam generator for household use having a handpiece held by the user. The handpiece is provided with a potentiometer operable by a roller and connected, by a low voltage line incorporated in a steam conduit, to an electronic circuit which controls a motorized electrovalve for adjustment of the flow of steam. A switch mounted in series with the potentiometer, also carried by the handpiece, enables the steam flow to be interrupted completely.

5 Claims, 1 Drawing Sheet

CONTROLLER FOR STEAM GENERATOR FOR HOUSEHOLD USE

BACKGROUND OF THE INVENTION a) Field of the Invention

The present invention relates generally to a steam generator for household use, and more particularly to a controller therefor.

b) Description of the Prior Art

Such a steam generator or apparatus, which is known per se, is used either for carrying out the cleaning of surfaces like grounds, walls, panes of glass, mirrors, clothes, carpets, moquettes or others, or for ironing. In some forms of such apparatus, the handpiece which is held by the operator is provided with a switch operative to control an electro-valve of the generator, to enable the flow of steam to be interrupted or reestablished. In such apparatus, however, the flow of steam cannot be adjusted by the operator directly from the handpiece because the on-off control is operated by the main supply current and it is dangerous to supply such current directly to the handpiece.

SUMMARY OF THE INVENTION

The object of the present invention is to remove the foregoing disadvantage.

The object is achieved by the fact that, in the apparatus according to the invention, the handpiece held by the user of the apparatus is provided with a control member connected, by a low voltage electrical line incorporated with the steam conduit connecting the steam generator to the handpiece, to a valve for adjustment of the flow of steam with which the steam generator is provided in such manner that the valve and hence the flow of steam can be controlled remotely by the user of the apparatus.

The various features of the invention will be apparent from the following description, drawings and claims, the scope of the invention not being limited to the drawings themselves as the drawings are only for the purpose of illustrating ways in which the principles of the invention can be applied. Other embodiments of the invention utilizing the same or equivalent principles may be used and structural changes may be made as desired by those skilled in the art without departing from the present invention and the purview of the appended claims.

DESCRIPTION OF THE PREFERRED EMBODIMENTS

The household apparatus illustrated comprises a steam generator, generally designated by reference 1, which will not be disclosed here in detail, the constructional features of this generator not being germane to the present invention and such generators being, moreover, well known per se.

The generator 1 feeds, by means of a flexible conduit 2, a mouth 3 intended to be moved on the surface to be cleaned. This same generator could also be used for feeding a laundry iron with steam, for example.

Figure 1:
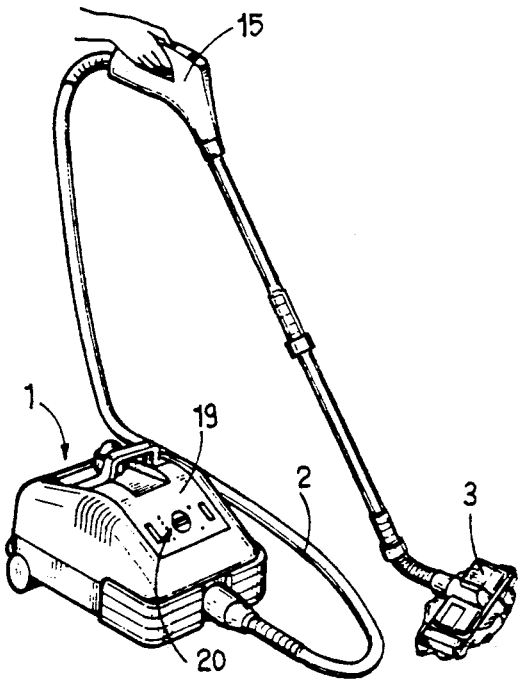
FIG. 1 is a perspective view of a household apparatus comprising a steam generator.
Figure 2:
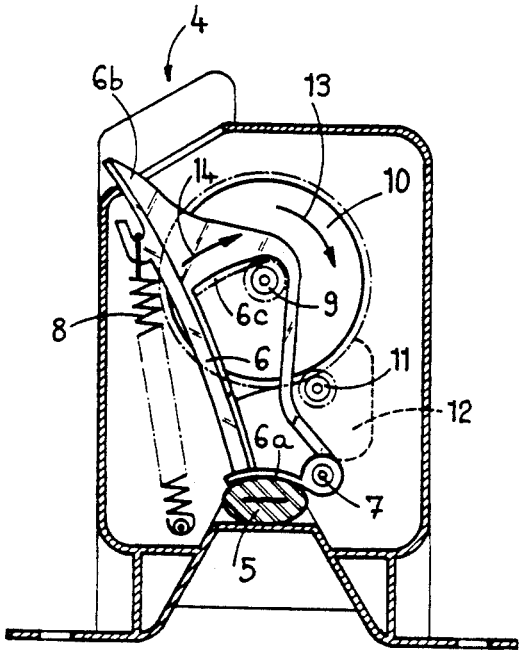
FIG. 2 is a diagrammatic sectional view of a detail of the steam generator.

The generator 1 comprises, situated in the vicinity of its steam output, a motorized electro-valve operative for adjustment of the flow of steam, generally designated by reference 4 in FIG. 2 where this valve is diagrammatically represented. The valve 4 acts by exerting a pressure on the steam conduit of the generator, designated by reference 5, which is formed of a material which is supple and resiliently deformable. To this effect, the valve 4 comprises a lever 6, pivoted at 7 on a frame of the valve, which is provided with a portion **6*a* having the shape of a hammer, which presses on the conduit 5. A coil return spring 8 acts on the lever 6 for urging it into the position shown in FIG. 2** corresponding to closed position of the valve.

The lever 6 is provided with an accessible portion **6*b* permitting, if desired, especially during pre-adjustment of the apparatus, manual release of the conduit 5**.

The lever 6 is moreover provided with a toothed portion **6*c*, constituting a rack, meshing with a pinion 9 rigid with a wheel 10 which itself meshes with a pinion 11 driven by an electric motor 12 partially represented in dot-and-dash lines in FIG. 2. When the motor 12 drives the pinion 11 so as to turn the wheel 10 in the direction of the arrow 13, the lever 6 is displaced in the direction of the arrow 14, so as to move hammer 6*a*, releasing the pressure onto the steam conduit 5 to increase the steam flow. The displacements of the lever 6** are relatively slow so that the variations of the flow of steam are not effected abruptly and so that fine adjustment of the flow of steam can be effected.

Figure 3:
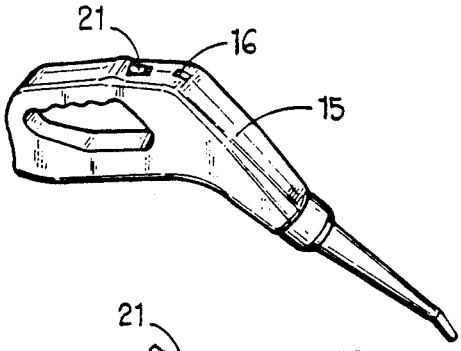
FIG. 3 is a perspective view, to a larger scale than that of FIG. 1, of the handpiece controller of the apparatus.

The electro-valve hereinbefore described is able to be controlled remotely due to the fact that the handpiece, generally designated by reference 15 (FIGS. 3 and 4), which is held by the operator when the apparatus is in use, and which is situated at the end of the flexible conduit 2, is provided with a control member constituted by a roller 16 rotatably mounted on the frame of the handpiece 15. The roller 16 drives a potentiometer 17 which is shown diagrammatically and connected, by a low voltage electrical line 18 incorporated with the conduit 2, to the electric circuit of the apparatus, which operates the motor 12 and thus controls the electro-valve 4.

Figure 4:
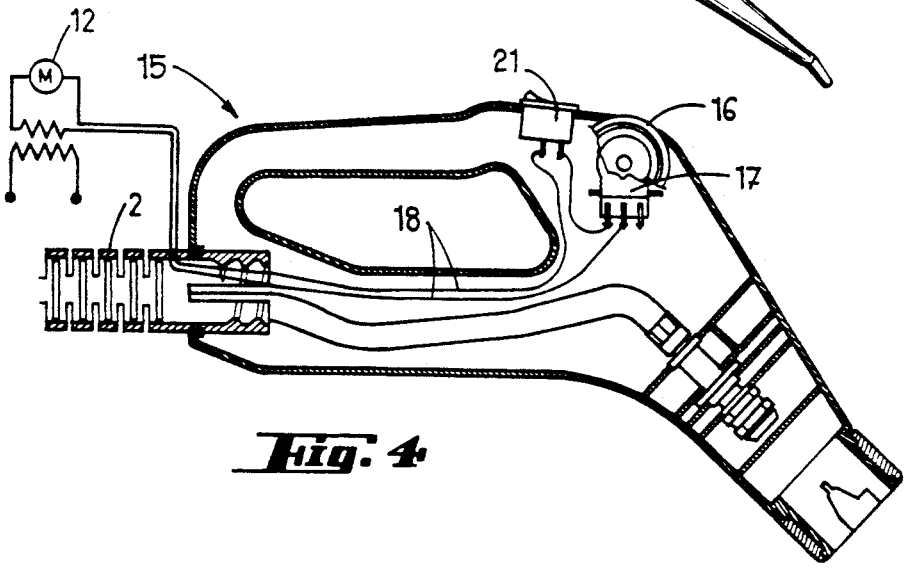
FIG. 4 is a diagrammatic sectional view of said handpiece controller and including a low voltage circuit.

FIG. 4 shows how the low voltage may be obtained by down transforming the main supply voltage. The potentiometer 17 controlled low voltage is applied to motor 12 which in turn controls the position of lever 6 and thus the pressure applied to the steam conduit.

It is to be noted that the front or dash-board, designated by reference 19, of the steam generator 1 is provided with an array 20 of luminous signal lamps, which enable the operator by known electrical connections to visualize the volume of the flow of steam as has been adjusted by the potentiometer 17.

A switch 21, mounted in series with the potentiometer 17, enables the low voltage current feeding the potentiometer to be cut off, the arrangement being such that, when the potentiometer is not fed with current, the valve 4 moves by itself, under the effect of the return spring 8, into the closed position which interrupts the flow of steam.

Thus, the adjustment of the flow of steam, even its interruption, is achieved directly from the handpiece held by the operator and, moreover, without it being necessary to bring a current at main supply voltage into the handpiece, but only a low voltage current which presents no danger to the operator.

I claim:

1. A steam generator including a steam conduit from the generator to a handpiece to be held by the user, the handpiece including a control member, a valve means for varying the cross-section of the steam conduit in the steam generator to adjust the flow of steam to the handpiece, and a low voltage electrical line connecting the control member to the valve means, whereby the flow of steam is controlled remotely from the generator by the user operating the control member, said control member including a potentiometer in the low voltage electrical line to variably control the voltage applied to the valve means and thereby variably adjust the flow of steam to the handpiece.

2. A generator as claimed in claim 1 including a switch in the low voltage electrical line to cut off the low voltage electrical line and thereby effect closing of the valve means.

3. A steam generator controller comprising:

a handpiece to be held by a user, said handpiece located remote from a steam generator;

a steam conduit from the steam generator to the handpiece;

an electrically controlled valve located at the steam generator for controlling the cross-section of the steam conduit;

said handpiece including a continuously variable control member in series with a low voltage electrical circuit;

said low voltage electrical circuit including a line connecting the control member to the electrically controlled valve, whereby the flow of steam through the handpiece can be adjusted by the user operating the control member.

4. A steam generator including a steam conduit from the generator to a handpiece to be held by the user, the handpiece including a control member, a valve means for varying the cross-section of the steam conduit in the steam generator to adjust the flow of steam to the handpiece, and a low voltage electrical line connecting the control member to the valve means for controlling the valve means, said valve means including a motor and a movable member for pressing said movable member against the steam conduit, the steam conduit being supple and elastically deformable by said movable member pressing thereon and said motor further operable to drive the movable member to release the pressure on the steam conduit by operation of the control member to thereby increase the cross-section of the steam conduit and to increase the steam flow.

5. The steam generator of claim 4, wherein said movable member for pressing against the steam conduit includes a spring for urging the movable member into a position in which the steam conduit is fully compressed and the flow of steam is interrupted.

* * * * *